US011758983B2

(12) United States Patent
Baucom et al.

(10) Patent No.: US 11,758,983 B2
(45) Date of Patent: Sep. 19, 2023

(54) S-SHAPED CLEAT STRUCTURES AND INTERMIXED CLEAT PATTERNS FOR ARTICLES OF FOOTWEAR

(71) Applicant: NIKE, Inc., Beaverton, OR (US)

(72) Inventors: Jim Baucom, Portland, OR (US); Josh A. Fedderly, Portland, OR (US); Zach F. Fitean, Portland, OR (US); John Hlavacs, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 66 days.

(21) Appl. No.: 17/343,720

(22) Filed: Jun. 9, 2021

(65) Prior Publication Data

US 2022/0395050 A1 Dec. 15, 2022

(51) Int. Cl.
*A43C 15/16* (2006.01)

(52) U.S. Cl.
CPC ..... *A43C 15/162* (2013.01); *A43C 15/161* (2013.01)

(58) Field of Classification Search
CPC .. A43B 5/00; A43B 5/02; A43B 13/10; A43B 5/185; A43C 15/02; A43C 15/162; A43C 15/161; A43C 15/16
See application file for complete search history.

(56) References Cited

U.S. PATENT DOCUMENTS 3,040,450 A * 6/1962 Phillips ..... A43C 15/162 264/261
3,747,237 A 7/1973 Wilowski
4,107,858 A 8/1978 Bowerman et al.
6,457,264 B2 * 10/2002 Fusco ..... A43C 15/162 D2/908
7,823,301 B2 11/2010 Belluto
8,713,819 B2 5/2014 Auger et al.
8,806,779 B2 8/2014 Auger et al.
8,966,787 B2 3/2015 Auger et al.
9,032,645 B2 5/2015 Stauffer
9,220,320 B2 12/2015 Auger et al.
(Continued)

FOREIGN PATENT DOCUMENTS

DE 2634362 A1 2/1977
GB 191211841 A 2/1913
(Continued)

*Primary Examiner* — Sharon M Prange
*Assistant Examiner* — Erick I Lopez
(74) *Attorney, Agent, or Firm* — Quinn IP Law

(57) ABSTRACT

Presented are S-shaped cleats for footwear, methods for making/using S-shaped cleats, and footwear fabricated with S-shaped cleats. A cleat structure for an article of footwear includes a mounting base, such as a pair of coplanar mounting plates, that attaches to the footwear's sole structure. A center wall projects downwardly from the mounting base and has opposing lateral sides with a distal end extending therebetween. A pair of sidewalls each projects downwardly from the base and adjoins a respective lateral side of the center wall. Each sidewall has a respective angled edge that projects at an oblique angle from the distal end of the center wall. The two sidewalls are located on opposing sides of the center wall; the sidewalls may be parallel to and extend in opposite directions of each other. The center wall and sidewalls may be substantially flat panels with multiple polygonal faces or may have arcuate sides.

25 Claims, 5 Drawing Sheets

(56) References Cited

U.S. PATENT DOCUMENTS

| | | | | |
|---|---|---|---|---|
| 2013/0067772 | A1* | 3/2013 | Auger | A43B 17/02 36/103 |
| 2017/0188662 | A1 | 7/2017 | Baucom et al. | |
| 2017/0224053 | A1 | 8/2017 | Truelsen et al. | |
| 2018/0125169 | A1 | 5/2018 | Hirai | |
| 2019/0387835 | A1 | 12/2019 | Yahata et al. | |

FOREIGN PATENT DOCUMENTS

| | | | |
|---|---|---|---|
| JP | 2004081511 | A | 3/2004 |
| RU | 2704936 | C1 | 10/2019 |

* cited by examiner

S-SHAPED CLEAT STRUCTURES AND INTERMIXED CLEAT PATTERNS FOR ARTICLES OF FOOTWEAR

TECHNICAL FIELD

The present disclosure relates generally to articles of footwear. More specifically, aspects of this disclosure relate to athletic shoes with ground engaging elements, such as studs or cleats, for increased traction and stability.

BACKGROUND

Articles of footwear, such as shoes, boots, slippers, sandals, and the like, are generally composed of two primary elements: an upper for securing the footwear to a user's foot, and a sole for providing subjacent support to the foot. Uppers may be fabricated from a variety of materials, including textiles, polymers, natural and synthetic leathers, etc., that are stitched or bonded together to form a shell or harness for securely receiving a foot. Many sandals and slippers, for example, have an upper with an open toe and/or open heel construction. Some designs employ an upper that is limited to a series of straps extending over the instep and, optionally, around the user's ankle. Conversely, many boot and shoe designs employ a full upper with a closed toe and heel construction that encases the foot. An ankle opening through a rear quarter portion of the upper provides access to the footwear's interior, facilitating entry and removal of the foot into and from the upper. A lace or strap may be utilized to secure the foot within the upper.

A sole structure is mounted to the underside of the upper, positioned between the user's foot and the ground. In many articles of footwear, including athletic shoes and boots, the sole structure is a layered construction that generally incorporates a comfort-enhancing insole, an impact-mitigating midsole, and a surface-contacting outsole. The insole is typically a thin and compressible member that provides a contact surface for the underside "plantar" region of the user's foot. By comparison, the midsole is mounted underneath the insole, forming a middle layer of the sole structure. In addition to attenuating ground reaction forces, the midsole may help to control foot motion and impart enhanced stability. Secured underneath the midsole is an outsole that forms the ground-contacting portion of the footwear. The outsole is usually fashioned from a durable, wearproof material that includes tread patterns engineered to improve traction.

When participating in activities with soft or slippery ground surfaces, such as the sports of football, baseball, golf, soccer, track & field, etc., it is often advantageous to use footwear with sole structures that provide increased traction and stability. For sports that are typically played on a grass-covered field or a dirt-covered track, for example, participating athletes may wear cleated athletic shoes with traction-enhancing outsole extensions—cleats—that penetrate the playing surface and concomitantly stabilize the athlete's feet from inadvertent movement. For activities in which it is objectionable to damage the competition field, athletes may use traction-enhancing sole structure elements, such as "soft spike" cleats, that project from the ground-facing surface of the footwear's outsole and contact the field surface without intentionally piercing it. Conventional cleat designs employ geometric protrusions, such as frustoconical, spike, or blade-like studs, that are manufactured from plastic or metal materials and arranged in a pattern of rows and columns. Moreover, most cleated shoes employ a single type of cleat that share a common size and a common orientation.

SUMMARY

Presented herein are S-shaped cleats for articles of footwear, methods for making and methods for using such S-shaped cleats, and footwear fabricated with such S-shaped cleats. In a non-limiting example, a rigid cleat is fabricated with a center wall and a pair of substantially parallel sidewalls each adjoined along one edge thereof to a respective lateral side of the center wall. All three cleat walls may be substantially flat with the sidewalls projecting generally orthogonally from the center wall and in opposite directions from each other. Optionally, the center wall may have curved lateral sides that each adjoins with a curved side of one of the sidewalls. Ground-facing bottom edges of the sidewalls may be bevelled such that the sidewalls, when viewed from the side, are right trapezium with the bevelled edges projecting from the center wall at an oblique angle, e.g., of about 40-45 degrees. A pair of mutually parallel mounting plates project transversely from top edges of the sidewalls opposite the bevelled edges. All three walls may project generally orthogonally from the mounting plates. It may be desirable, e.g., for ease of manufacture and assembly, that the cleat's center wall, sidewalls, and (optional) mounting plates be integrally formed as a single-piece, unitary structure.

Aspects of this disclosure are directed to S-shaped cleats and intermixed cleat arrangements with modifiable cleat orientations for athletic shoes. In an example, a cleat structure is presented for an article of footwear. The article of footwear has a sole structure for supporting a user's foot and for contacting a ground surface. The cleat structure includes a mounting base that detachably or permanently mounts to the sole structure. A first wall projects from the mounting base and has opposing lateral sides with a distal end that extends between the first wall's lateral sides. A first sidewall also projects from the base and adjoins a first lateral side of the first wall. The first sidewall has a first angled edge that projects at a first oblique angle from the first wall's distal end. Likewise, a second sidewall projects from the base and adjoins a second lateral side of the first wall. The first sidewall is located on one side of the first wall and the second sidewall is located on another side of the first wall opposite that of the first sidewall. The second sidewall has a second angled edge that projects at a second oblique angle from the first wall's distal end.

Further aspects of the present disclosure are directed to footwear with S-shaped cleats and footwear with intermixed cleat arrangements and distinct cleat orientations. For instance, an article of footwear, such as an athletic shoe, includes an upper that receives and attaches to the user's foot. A single-piece or multilayered sole structure is attached to a lower portion of the upper and supports thereon the user's foot. This sole structure includes an outsole that defines a ground-engaging portion of the footwear. In this regard, an engineered pattern of cleats may project downwardly from the ground-engaging outsole. This pattern of cleats may include a single cleat type (e.g., only S-shaped cleats), multiple distinct types of cleats (e.g., both S-shaped and blade-shaped cleats), and/or cleats with a single or multiple orientation (e.g., a plurality of cleats each located at a discrete location and having a distinct angular orientation with respect to the sole structure).

Continuing with the foregoing discussion, at least one of the cleats includes a mounting base that is rigidly or movably attached to the footwear's sole structure. A center (first) wall is attached at a proximal end thereof to and projects downwardly from the mounting base. The center wall has opposing lateral sides and a distal end, opposite the proximal end, that extends between the two lateral sides. A pair of (first and second) sidewalls projects downwardly from the base and each adjoins a respective lateral side of the center wall. Each sidewall has an angled distal edge that projects at an oblique angle from a respective lateral edge of the center wall's distal end. The first sidewall is located on a first side of the center wall, whereas the second sidewall is located on a second side of the center wall opposite that of the first sidewall.

Additional aspects of this disclosure are directed to manufacturing processes, control logic, and computer readable media for fabricating any of the disclosed cleat structures, engineered cleat patterns, and footwear. In an example, a method is presented for manufacturing a cleat structure for an article of footwear. This representative method includes, in any order and in any combination with any of the above or below disclosed features and options: forming a mounting base configured to attach to the sole structure; forming a first wall projecting from the mounting base and having opposing first and second lateral sides with a distal end extending between the first and second lateral sides; forming a first sidewall projecting from the base and adjoining the first lateral side of the first wall, the first sidewall having a first angled edge projecting at a first oblique angle from the distal end of the first wall; and forming a second sidewall projecting from the base, adjoining the second lateral side, and located on a respective side of the first wall opposite that of the first sidewall, the second sidewall having a second angled edge projecting at a second oblique angle from the distal end of the first wall.

For any of the disclosed cleats, methods, and footwear, the first cleat sidewall may be substantially parallel with respect to the second cleat sidewall. As yet a further option, the first and second sidewalls may extend in opposite directions from each other. Moreover, the first and second sidewalls may be substantially orthogonal with respect to the cleat's center wall. All three of the cleat walls may be perpendicular with respect to the cleat's mounting base. The angled edges of the sidewalls may extend at oblique angles of between about 35 degrees and about 55 degrees or, in at least some preferred configurations, an angle of 43±3 degrees. The cleat's mounting base, center wall, and sidewalls may be integrally formed, e.g., from a metallic material or a plastic material, as a single-piece structure. Disclosed cleat designs and intermixed cleat patterns not only provide improved traction and stability, e.g., during forward and lateral gait, but also optimize foot-to-foot power transfer, e.g., during swinging and throwing movements.

For any of the disclosed cleats, methods, and footwear, the cleat's center wall and two sidewalls may each be a substantially flat panel with opposing major faces having polygonal shapes. As an example, the cleat sidewalls may each have polyhedral geometries with opposing major faces having right trapezium shapes. The center panel may have an orthogonal polyhedron shape with opposing major faces having rectangular shapes. Alternatively, the cleat's center wall and two sidewalls may have curved sides and, if desired, rounded or beveled edges. For instance, the lateral sides of the center wall may be arcuate, and the sidewall sides that adjoin the center wall's lateral sides may also be arcuate. Disclosed cleat designs and intermixed cleat patterns help to decrease the total number of individual cleats needed to maintain predefined traction and stability characteristics; in so doing, the total mass of each shoe may be markedly reduced.

For any of the disclosed cleats, methods, and footwear, the mounting base may include a first mounting plate that projects from a proximal end of the first sidewall and a second mounting plate that projects from a proximal end of the second sidewall. Each mounting plate may project orthogonally from the proximal end of its respective sidewall. As yet a further option, the first mounting plate projects in a first direction from the first sidewall and the second mounting plate projects in a second direction, opposite the first direction, from the second sidewall. Each mounting plate may include a through-hole for receiving a fastener that secures the mounting plate and, thus, the cleat to the sole structure. Alternatively, the mounting plates may be embedded within or may be replaced by a threaded or keyed base that releasably attaches the cleat to a complementary cavity within the ground-facing outsole of the sole structure.

The above summary is not intended to represent every embodiment or every aspect of the present disclosure. Rather, the foregoing summary merely provides an exemplification of some of the novel concepts and features set forth herein. The above features and advantages, and other features and attendant advantages of this disclosure, will be readily apparent from the following detailed description of illustrated examples and representative modes for carrying out the present disclosure when taken in connection with the accompanying drawings and the appended claims. Moreover, this disclosure expressly includes any and all combinations and subcombinations of the elements and features presented above and below.

Figure 1:
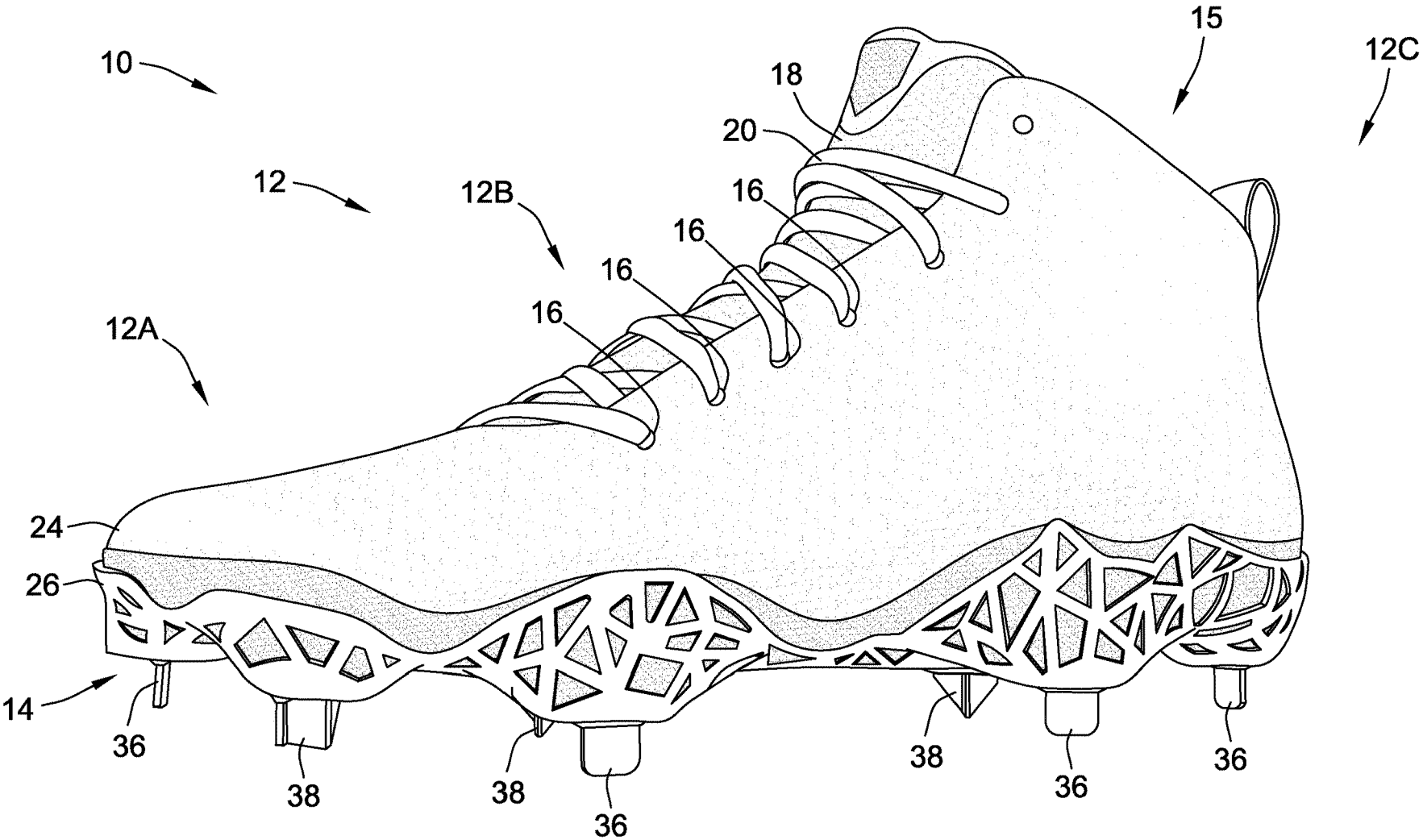
FIG. 1 is a side, perspective-view illustration of a representative article of footwear with S-shaped cleats intermixed with blade-shaped cleats in a computationally engineered pattern in accordance with aspects of the present disclosure.

The present disclosure is amenable to various modifications and alternative forms, and some representative embodiments have been shown by way of example in the drawings and will be described in detail below. It should be understood, however, that the novel aspects of this disclosure are not limited to the particular forms illustrated in the above-enumerated drawing. Rather, the disclosure is to cover all modifications, equivalents, combinations, subcombinations, permutations, groupings, and alternatives falling within the scope of this disclosure as encompassed by the appended claims.

DETAILED DESCRIPTION

This disclosure is susceptible of embodiment in many different forms. There are shown in the drawings and will herein be described in detail representative embodiments of the disclosure with the understanding that these illustrated examples are provided as an exemplification of the disclosed principles, not limitations of the broad concepts of the disclosure. To that extent, elements and limitations that are described, for example, in the Abstract, Technical Field, Background, Summary, Description of the Drawings, and Detailed Description sections, but not explicitly set forth in the claims, should not be incorporated into the claims, singly or collectively, by implication, inference or otherwise.

For purposes of the present detailed description, unless specifically disclaimed: the singular includes the plural and vice versa; the words "and" and "or" shall be both conjunctive and disjunctive; the words "any" and "all" shall both mean "any and all"; and the words "including," "containing," "comprising," "having," permutations thereof, and like terms, shall each mean "including without limitation." Moreover, words of approximation, such as "about," "almost," "approximately," "substantially," "generally," and the like may be used herein in the sense of "at, near, or nearly at," or "within 0-5% of," or "within acceptable manufacturing tolerances," or any logical combination thereof, for example. Lastly, directional adjectives and adverbs, such as fore, aft, medial, lateral, proximal, distal, vertical, horizontal, front, back, left, right, etc., may be with respect to an article of footwear when worn on a user's foot and operatively oriented with the base of the sole structure seated on a flat surface, for example.

Referring now to the drawings, wherein like reference numbers refer to like features throughout the several views, there is shown in FIG. 1 a representative article of footwear, which is designated generally at 10 and portrayed herein for purposes of discussion as an athletic shoe in the form of a "pitcher cleat". The illustrated article of footwear 10—also referred to herein as "footwear" or "shoe" for brevity—is an exemplary application with which novel aspects of this disclosure may be practiced. In the same vein, implementation of the present concepts for a multi-layered sole structure with an exoskeletal cleat cage should also be appreciated as a representative implementation of the disclosed concepts. It will therefore be understood that aspects and features of this disclosure may be utilized for other athletic and non-athletic activities, may be integrated into other sole structure configurations, and may be incorporated into any logically relevant type of footwear. As used herein, the terms "shoe" and "footwear", including permutations thereof, may be used interchangeably and synonymously to reference any suitable type of garment worn on a human foot. Lastly, features presented in the drawings are not necessarily to scale and are provided purely for instructional purposes. Thus, the specific and relative dimensions shown in the drawings are not to be construed as limiting.

Figure 2:
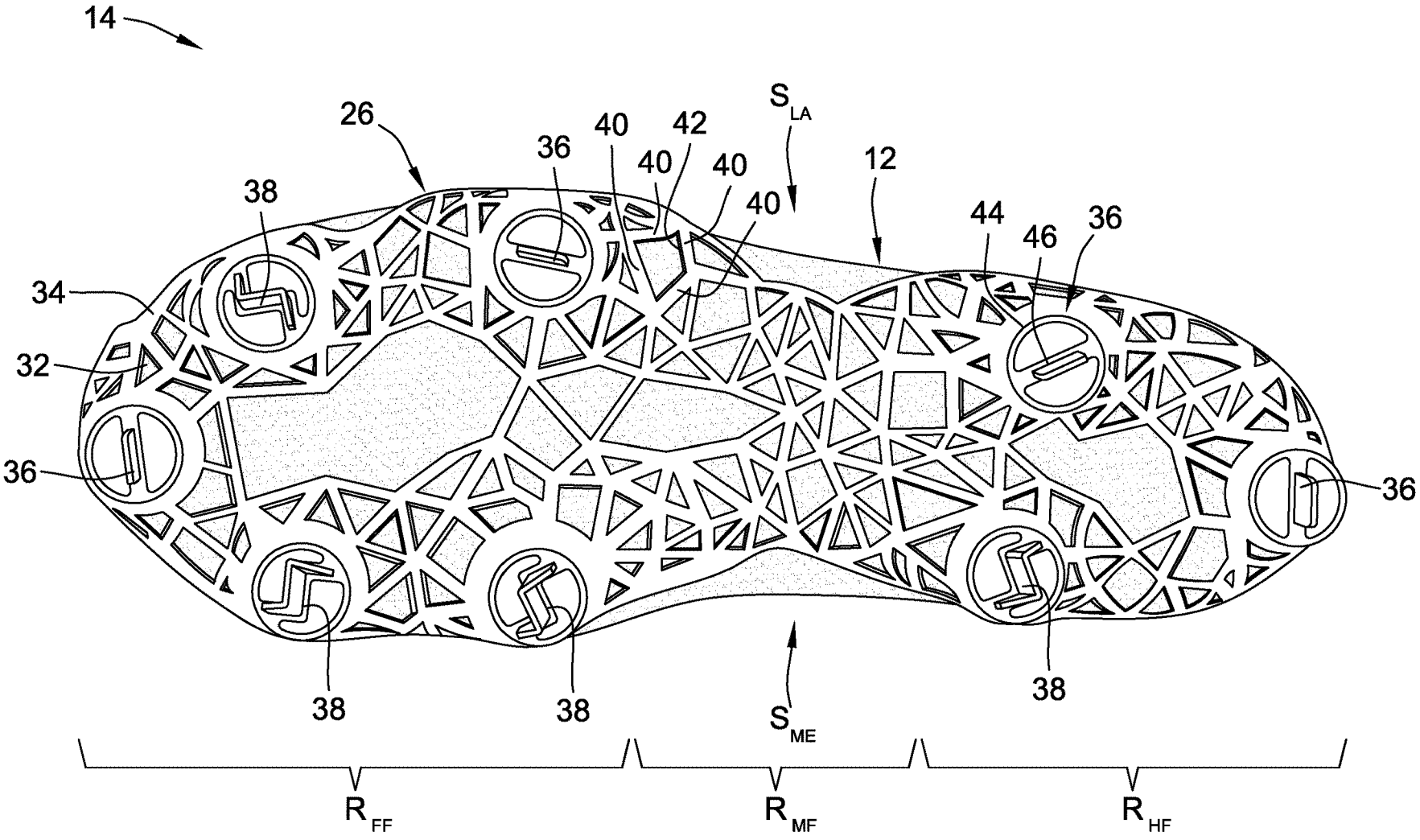
FIG. 2 is a bottom-view illustration of the sole structure with intermixed cleat design of the representative footwear of FIG. 1.

The representative article of footwear 10 is generally depicted in FIGS. 1 and 2 as a bipartite construction that is primarily composed of a foot-receiving upper 12 mounted on top of a subjacent sole structure 14. For ease of reference, footwear 10 may be divided into three anatomical regions: a forefoot region $R_{FF}$, a midfoot region $R_{MF}$, and a hindfoot (heel) region $R_{HF}$, as shown in FIG. 2. In accordance with recognized anatomical classifications, the forefoot region $R_{FF}$ is located at the front of the footwear 10 and generally corresponds with the phalanges (toes), metatarsals, and any interconnecting joints thereof. Interposed between the forefoot and hindfoot regions $R_{FF}$ and $R_{HF}$ is the midfoot region $R_{MF}$, which generally corresponds with the cuneiform, navicular, and cuboid bones (i.e., the arch area of the foot). Hindfoot region $R_{HF}$, in contrast, is located at the rear of the footwear 10 and generally corresponds with the talus (ankle) and calcaneus (heel) bones.

Footwear 10 of FIGS. 1 and 2 may also be divided along a vertical plane into a lateral segment $S_{LA}$ and an adjoining medial segment $S_{ME}$. The lateral segment $S_{LA}$ may be typified as a distal half of the shoe 10 farthest from the sagittal plane of the human body. Conversely, the medial segment $S_{ME}$ may be typified as a proximal half of the shoe 10 closest to the sagittal plane of the human body. Both lateral and medial segments $S_{LA}$ and $S_{ME}$ of the footwear 10 extend through all three anatomical regions $R_{FF}$, $R_{MF}$, $R_{HF}$, and each corresponds to a respective transverse side of the footwear 10. While only a single shoe 10 for a left foot of a user is shown in FIGS. 1 and 2, a mirrored, structurally similar counterpart may be provided for a right foot of a user. Recognizably, the shape, size, material composition, and method of manufacture of the shoe 10 may be varied, singly or collectively, to accommodate practically any conventional or nonconventional footwear application.

With reference again to FIG. 1, the upper 12 is depicted as having a shell-like construction with a closed toe and heel configuration for encasing a human foot. Upper 12 is generally defined by three adjoining sections, namely a toe box 12A, a vamp 12B, and a rear quarter 12C. The toe box 12A is shown as a rounded forward tip of the upper 12 that extends from distal to proximal phalanges to cover and protect the user's toes. By comparison, the vamp 12B is an arched midsection of the upper 12 that is located aft of the toe box 12A and extends from the metatarsals to the cuboid. As shown, the vamp 12B also defines a throat with a fore-aft-spaced series of lace eyelets 16 and a shoe tongue 18. Positioned aft of the vamp 12B is a rear quarter 12C section that the defines the rear end and rear sides of the upper 12. Rear quarter 12C wraps around the calcaneus bone and originates/terminates at the transverse ends of the tarsal joint. While portrayed in the drawings as comprising three primary segments, the upper 12 may be fabricated as a single-piece construction or may be composed of any number of segments, including a toe shield, heel cap, ankle cuff, interior liner, etc. For sandal and slipper applications, the upper 12 may take on an open toe or open heel configuration or, optionally, may be replaced with a single strap or a set of interconnected straps.

The upper 12 portion of the footwear 10 may be fabricated from any one or combination of a variety of materials, such as textiles, engineered foams, polymers, natural and synthetic leathers, etc. Individual segments of the upper 12, once assembled or cut to shape and size, may be stitched, adhesively bonded, fastened, welded, or otherwise joined together to form an interior void for comfortably receiving a foot. The individual material elements of the upper 12 may be selected and located with respect to the footwear 10 in order to impart desired properties of durability, air-permeability, wear-resistance, flexibility, appearance, and comfort, for example. An ankle opening 15 in the rear quarter 12C of the upper 12 provides access to the interior of the shoe 10. A shoelace 20, strap, buckle, or other commercially available mechanism may be utilized to modify the girth of the upper 12 in order to more securely retain the foot within the interior of the shoe 10 as well as to facilitate entry and removal of the foot from the upper 12. Shoelace 20 may be threaded through the series of eyelets 16 in the upper 12; the tongue 18 may extend between the lace 20 and the interior void of the upper 12.

Sole structure 14 is rigidly secured to the upper 12 such that the sole structure 14 extends between the upper 12 and a support surface upon which a user stands. In effect, the sole structure 14 functions as an intermediate support platform that separates and protects the user's foot from the ground. In addition to attenuating ground reaction forces and providing cushioning for the foot, sole structure 14 of FIGS. 1 and 2 may provide traction, impart stability, and help to limit various foot motions, such as inadvertent foot inversion and eversion. It is envisioned that the sole structure 14 may be attached to the upper 12 via any presently available or hereinafter developed joining techniques. For at least some applications, the upper 12 may be coupled directly to the midsole 24, e.g., with the upper 12 adhesively attached to an outer periphery of a midsole sidewall and secured with a bonding allowance via priming, cementing, and pressing.

In accordance with the illustrated example, the sole structure 14 is fabricated as a sandwich structure with a foot-contacting insole (located entirely inside the upper 12; not visible in the views provided), an intermediate midsole 24, and a bottom-most outsole 26. Alternative sole structure configurations may be fabricated with greater or fewer than three layers. Insole is located within an interior void of the footwear 10, operatively located at a lower portion of the upper 12 such that the insole abuts a plantar surface of the foot. Underneath the insole is a midsole 24 that incorporates one or more materials or embedded elements that enhance the comfort, performance, and/or ground-reaction-force attenuation properties of footwear 10. These elements and materials may include, individually or in any combination, a polymer foam material, such as polyurethane or ethyl vinyl acetate (EVA), filler materials, moderators, air-filled bladders, plates, lasting elements, or motion control members. Outsole 26 is located underneath the midsole 24, defining some or all of the bottom-most, ground-engaging portion of the footwear 10. The outsole 26 may be formed from a natural or synthetic rubber material that provides a durable and wear-resistant surface for contacting the ground. In addition, the outsole 26 may be contoured and textured to enhance the traction (i.e., friction) properties between footwear 10 and the underlying support surface.

Footwear 10 of FIGS. 1 and 2 may be specifically engineered for use during a designated activity, such as such as a sporting event or athletic training, in which it is advantageous to maintain fore-aft and medio-lateral stability while increasing static friction with the ground surface. Disclosed articles of footwear are provided with traction elements that protrude from a sole structure to collectively define the ground-contacting surface of the footwear. These traction elements are structurally configured to pierce or impress into the ground surface to thereby increase the footwear's gripping characteristics and, thus, help to secure contact between the user's foot and the ground. In addition, the traction elements may increase the overall surface area of the footwear's ground-contacting surface to concomitantly increase friction between the ground-contacting surface of the footwear and the ground or surface that it contacts.

In addition to presenting optimized individual cleat structures, also presented herein are computationally engineered cleat patterns each with a minimized cleat quantity, an intermix of cleat types, and individualized cleat locations/orientations. Disclosed cleat patterns may be selectively modified according to the type of ground surfaces on which the sole structure is intended to be used, for example, natural turf (e.g., poaceae grass), artificial turf (e.g., synthetic fiber matting), synthetic rubber surfaces (e.g., running tracks), dirt, snow, etc. In addition, the individual cleat patterns may be calculatingly varied according to the type of activity for which the footwear is anticipated to be used (e.g., running, hiking, climbing, baseball, football, soccer, and other activities). In addition, the cleat patterns may vary depending on the surface's relative hardness/softness and may be tailored for use in wet conditions or dry conditions. As will be described in further detail below, a computationally engineered cleat pattern may include a predefined total number of cleats (e.g., 6-10), a predefined set of intermixed cleats (e.g., S-shaped and blade-shaped cleats), a predefined maximum number of each cleat type (e.g., 3-5 S-shaped cleats and 3-5 blade-shaped cleats), a predefined location and orientation of each cleat (see examples in FIGS. 5A-5F). Disclosed cleat designs and intermixed cleat patterns help to improve traction and stability during forward and lateral gait while optimizing foot-to-foot power transfer, for example, during a swinging motion or a throwing motion.

According to the illustrated example, the outsole 26 of footwear 10 is located underneath the midsole 24 and fixedly attached to the bottom portion of the upper 14. The outsole 26 is shown as a cleated "exoskeleton" with a polygonal lattice structure that provides traction and stability on a variety of surfaces and in any of a variety of conditions while delivering dynamic cleat pressure dispersion for reduced fatigue and anatomical slip-lasting for improved arch fit. The exoskeletal outsole 26 may be formed by any suitable process, including injection molding, casting, thermoforming, etc., and may include aspects that are 3D printed, etched, shaped, trimmed, etc. As generally illustrated in FIG. 2, the outsole component 26 may include a substrate layer 32 that seats flush against the bottom surface of the midsole 24, and a support layer 34 that mounts flush over the substrate layer 32. The support layer 34 may be integral with and/or otherwise affixed to the substrate layer 32. For instance, the support layer 34 may be 3D printed onto the substrate layer 32, e.g., via a fused filament fabrication technique.

The support layer 34 may resemble a cage that is delineated by interconnected scaffold segments 40 with distinctly shaped apertures 42 interleaved between the adjoining scaffold segments 40. These scaffold segments 40 may be substantially linear bar structures and may serve to connect node points that are each defined by the intersection of three or more of the scaffold segments 40. Each aperture 42 may have a polygonal shape and, more particularly, may be limited to triangular apertures and quadrilateral apertures. It may be desirable that most or substantially all of the apertures 42 be distinct from one another in shape, size, and/or orientation. In some embodiments, support layer 40 may include at least 50 apertures or, alternatively, between about 100 and 400 apertures depending, for example, on the standardized shoe size of footwear 10.

As noted above, one or more traction elements protrude from the support layer 34 of outsole 26 to collectively define therewith the ground-contacting surface of the footwear 10. In accord with the illustrated example, multiple blade-shaped cleats 36 and multiple S-shaped cleats 38 are affixed to the substrate layer 32 and support layer 34, each extending downwardly from the footwear sole structure 14. As best seen in FIG. 1, each blade-shaped cleat 36 is a one-piece construction having a generally flat body 46 with two flat major faces, two straight sides, a straight distal end, and two rounded corners. The blade-shaped cleats 36 may be mutually oblique with one another and may all project at an oblique angle from the support layer 34. FIG. 2 illustrates each cleat 36 with a respective base portion 44 and a respective ground engaging portion, namely cleat body 46. The base portion 44 may extend into and/or through the support layer 34 and, optionally, into the substrate layer 32.

Figure 3A:
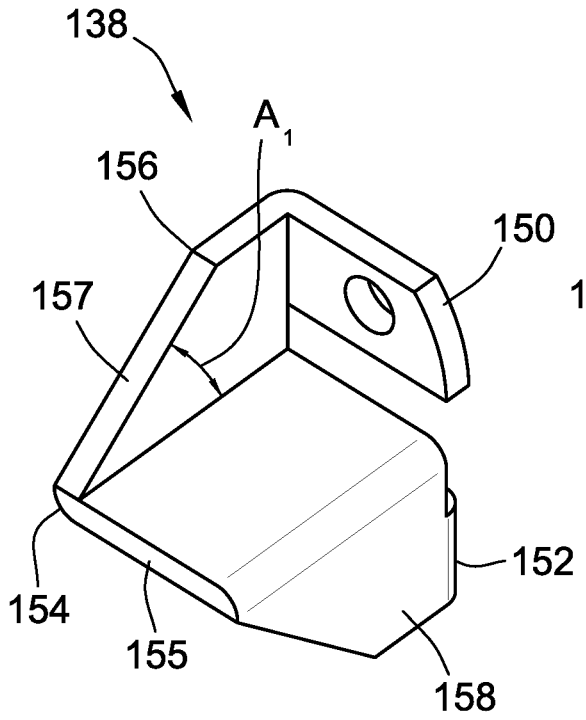
FIGS. 3A-3C are front perspective-view, rear perspective-view, and plan-view illustrations, respectively, of a representative S-shaped cleat with chamfered edges for an article of footwear in accordance with aspects of the present disclosure.
Figure 3B:
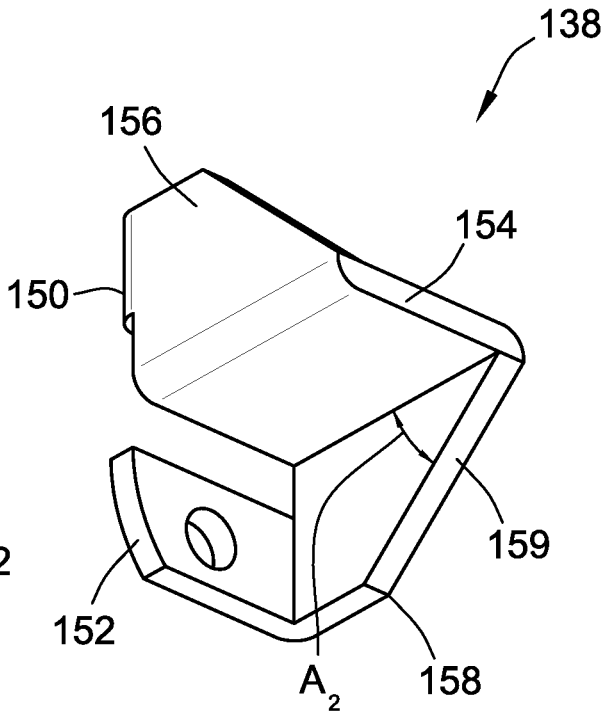

The S-shaped cleats 38 of FIGS. 1 and 2 may take on a biflected, serpentine construction with multiple beveled contact edges, including either or both of the S-shaped cleat structures ("cleats") 138 and 238 of FIGS. 3A-3C and 4A-4D, respectively, including combinations and permutations thereof. Turning first to FIGS. 3A and 3B, the S-shaped cleat structure 138 includes a mounting base 150, 152, a center (first) wall 154 projecting from a central region of the mounting base 150, 152, and a pair of (first and second) sidewalls 156 and 158 flanking the center wall 154 and projecting from respective longitudinal sides of the mounting base 150, 152. When removed from the footwear 10 and placed on the mounting base 150, 152, as observed in the plan-view illustration of FIG. 3C, the cleat 138 has a general "S" shape with the top (first) mounting plate 150 acting as the S's forward-extending arm, the lower (second) mounting plate 152 acting as the S's rearward-extending leg, and the three cleat walls 154, 156 and 158 acting as the S's spine that connects the leg and the arm.

Figure 3C:
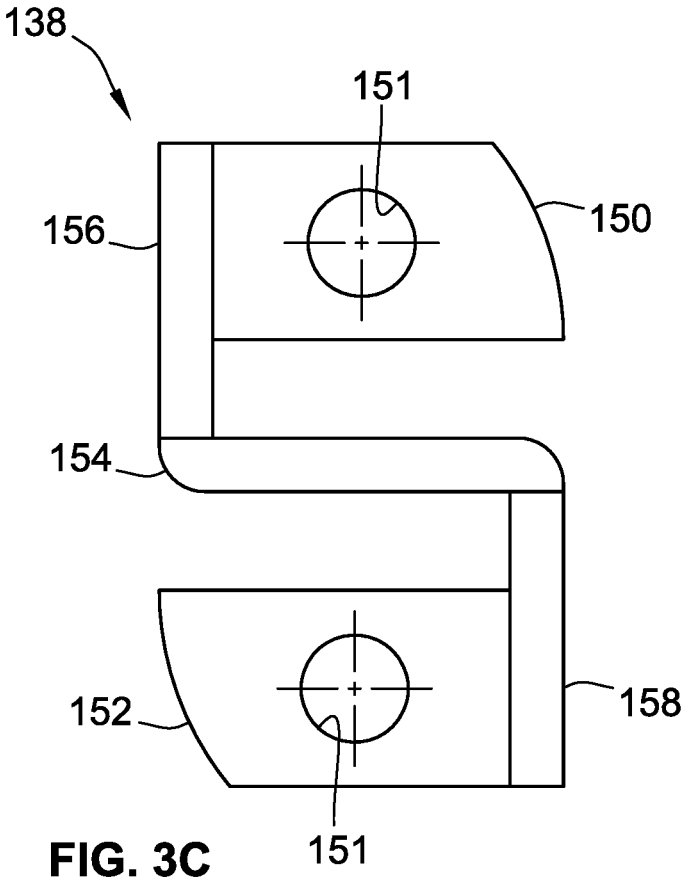

As shown in FIGS. 3A-3C, a longest lateral side of the top (first) sidewall 156 adjoins and is coterminous with a left lateral (first) side of the center wall 154. Likewise, a longest lateral side of the bottom (second) sidewall 158 adjoins and is coterminous with the opposite right lateral (second) side of the center wall 154. Additionally, the top sidewall 156 is located on a top (first) side of the center wall 154, whereas the bottom sidewall 158 is located on a bottom (second) side of the center wall 154 opposite that of the top sidewall 156. In keeping with the illustrated configuration, the top sidewall 156 is substantially parallel with the bottom sidewall 158, and both sidewalls 156, 158 are substantially orthogonal with the center wall 154. Moreover, the top sidewall 156 extends in one direction (vertically upwards in FIGS. 3A-3C) and the bottom sidewall 158 extends in the opposite direction (vertically downwards in FIGS. 3A-3C). For simplicity of design and ease of manufacture, the entire cleat structure 138, including the mounting base 150, 152, the center wall 154, and the two sidewalls 156, 158, may be integrally formed as a single-piece, unitary structure from a metallic material, polymeric material, or a combination of both. To this end, the cleat 138 may consist essentially of the mounting plates 150, 152, center wall 154, and sidewalls 156, 158.

All three of the cleat walls 154, 156, 158 are portrayed in FIGS. 3A-3C as substantially flat panels with polygonal faces. For instance, each of the cleat sidewalls 156, 158 has a 6-sided polyhedral geometry with opposing major faces (i.e., the largest geometric faces of the structure) having right trapezium shapes. Comparatively, the center wall 154 is a generally orthogonal polyhedron with filleted lateral edges and opposing major faces having rectangular shapes. It is envisioned that the cleat 138, including its individual walls 154, 156, 158, may take on other geometric shapes and sizes from that which are shown in the Figures. To that end, the cleat body may be fabricated with greater or fewer than the three illustrated cleat walls.

To help improve power transfer along selected planes of the footwear 10 during dynamic foot motion, the lowermost contact edges of the S-shaped cleat 138 may be beveled as opposed to being entirely flat. A distal (first) angled edge 157 (FIG. 3A) at a longitudinal end of the top sidewall 156, for example, is bevelled so as to project from a left edge of the distal end 155 of the center wall 154 towards the mounting base 150, 152 at an oblique angle $A_1$. In the same vein, a distal (second) angled edge 159 (FIG. 3B) at a longitudinal end of the bottom sidewall 158 is bevelled so as to project from a right edge of the distal end 155 of the center wall 154 towards the mounting base 150, 152 at an oblique angle $A_2$. The oblique angles $A_1$ and $A_2$ of the angled edges 157, 159 may both be acute angles of between about 35 degrees and about 55 degrees. It may be desirable, for at least some configurations, that the oblique angles $A_1$ and $A_2$ be substantially identical at 43±3 degrees. Optional designs may employ rounded and/or serrated edges in addition to, or as an alternative for, the bevelled angled edges 157, 159.

The S-shaped cleats 138 protrude downwardly from a ground-facing surface of the mounting base 150, 152 (i.e., the side opposite the remainder of the sole structure 14) in order to impinge into a ground surface during normal use of footwear 10. As noted above, the mounting base is depicted in FIGS. 3A-3C as a bipartite structure with two mounting plates: a top (first) mounting plate 150 that projects from a proximal (first) end of the top sidewall 156 opposite the angled edge 157; and a bottom (second) mounting plate 152 that projects from a proximal (second) end of the bottom sidewall 158 opposite the angled edge 159. The two mounting plates 150, 152 may be substantially flat panels that are coplanar and substantially parallel with each other. As best seen in FIG. 3C, the top mounting plate 150 projects substantially orthogonally in a rightward (first) direction from the top sidewall 156, whereas the bottom mounting plate 152 projects substantially orthogonally in a leftward (second) direction from the bottom sidewall 158.

Mounting base 150, 152 may movably and releasably attach the cleat 138 to the outsole 26. Both mounting plates 150, 152 are shown with a through-hole 151 for receiving a fastener, such as a threaded screw (not shown), that mechanically secures the mounting plate 150, 152 and, thus, the cleat 138 to the sole structure 14. As yet a further option, the mounting plates 150, 152 may be embedded within or, alternatively, may be replaced by a threaded or keyed base (e.g., base portion 44 of FIG. 2) that releasably attaches the cleat 138 to a complementary cavity within the ground-facing outsole 26 of the sole structure 14. Each mounting plate 150, 152 may have a rounded distal edge to facilitate selective rotation of the cleat 138 and a filleted proximal edge to facilitate mounting of the cleat 138 to the sole structure 14.

Figure 4B:
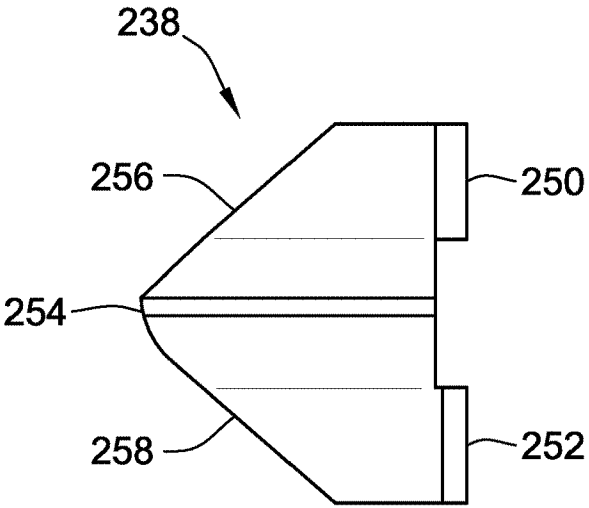
FIGS. 4A-4D are left, right, plan, and front-view illustrations, respectively, of another representative S-shaped cleat with chamfered edges for an article of footwear in accordance with aspects of the present disclosure.
Figure 4C:
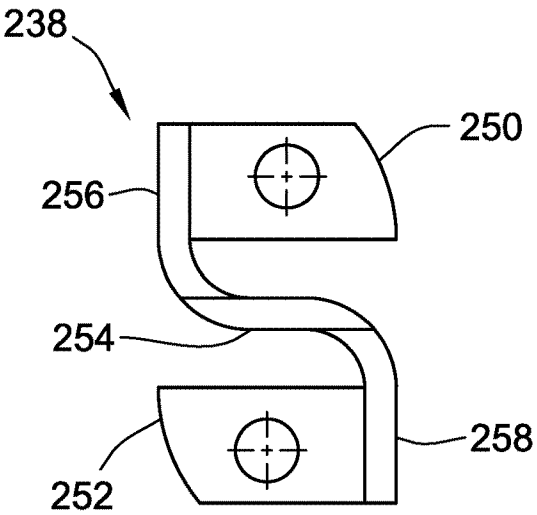
Figure 4A:
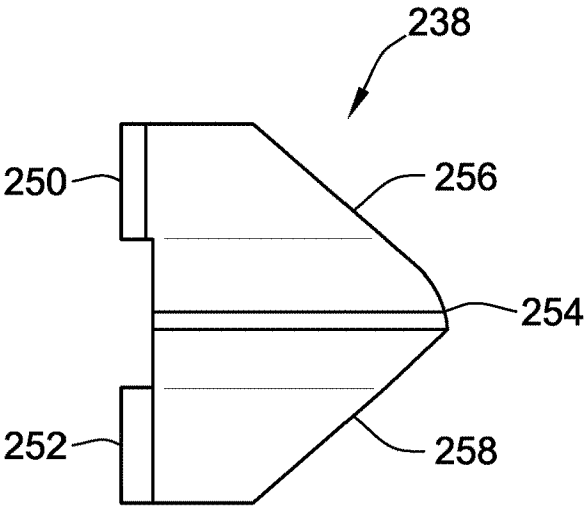

Turning next to FIGS. 4A-4D, there is shown another representative S-shaped cleat structure 238 for an article of footwear. Although differing in appearance, it is envisioned that any of the features and options described above with reference to the cleats 38 and 138 of FIGS. 1 and 3A-3C can be incorporated, singly or in any combination, into the cleat 238 of FIGS. 4A-4D, and vice versa. Similar to cleat structure 138 of FIGS. 3A-3C, for example, cleat structure 238 includes, or may consist essentially of, a mounting base 250, 252, a center (first) wall 254 projecting from a central region of the mounting base 250, 252, and a pair of (first and second) sidewalls 256 and 258 flanking the center wall 254 and projecting from respective longitudinal sides of the mounting base 250, 252. As another point of similarity, the plan-view illustration of FIG. 4C shows the cleat 238 with a general "S" shape with the top (first) mounting plate 250 acting as the S's forward-extending arm, the lower (second) mounting plate 252 acting as the S's rearward-extending leg, and the three cleat walls 254, 256 and 258 acting as the S's spine that connects the leg and the arm. In this regard, the two mounting plates 250, 252 may include any of the above-described features of mounting plates 150, 152, and the cleat walls 254, 256, 258 may include any of the above-described features of cleat walls 154, 156, 158, respectively.

Figure 4D:
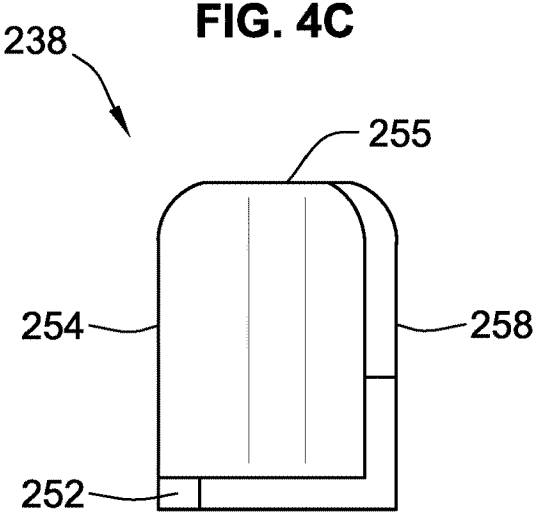

A representative point of demarcation between the two illustrated cleat designs can be seen by comparing FIG. 3C, wherein the cleat walls 154, 156, 158 of S-shaped cleat structure 138 collectively define a sawtooth-like profile, with FIG. 4C, wherein the cleat walls 254, 256, 258 of S-shaped cleat structure 238 collectively define a sinusoid-like profile. In particular, the three cleat walls 154, 156, 158 of FIGS. 3A-3C are illustrated as substantially flat panel members that intersect at right angle corners; the three cleat walls 254, 256, 258 of FIGS. 4A-4D, however, are illustrated as arcuate panel members that intersect at curved corners. Opposing lateral sides of the center wall 254 are arcuate, with the left side of the wall 254 shown in FIG. 4C as concave up and the right side of the wall 254 shown as concave down such that the midpoint of center wall 254 acts as an inflection point. Additionally, the sidewall sides of the two sidewalls 256, 258 that adjoin the lateral sides of the central wall are also arcuate. In so doing, the distal end 255 of the center wall 254 has rounded corners, as best seen in FIG. 4D, as opposed to the substantially flat distal end 155 of center wall 154, as seen in FIG. 3A.

Through empirical analysis and pressure mapping studies, it has been shown that discrete sections of an athlete's feet each play a significant role at different times during an athletic movement to transfer power from the athlete to an external object. For instance, when a baseball player swings a bat to hit a baseball: (1) traction may be dominant in the forefoot and hindfoot regions $R_{FF}$, $R_{HF}$ on the lateral segment $S_{LA}$ of the back foot during backswing and loading; (2) traction may be dominant in the forefoot region and hindfoot regions $R_{FF}$, $R_{HF}$ on the medial segment $S_{ME}$ of the back foot during the initial forward swing from the rear shoulder and transitioning of body weight to the front foot; (3) traction may be dominant in the forefoot region $R_{FF}$ and medial segment $S_{ME}$ of the lead foot during swing contact; and (4) traction may be dominant in the lateral segment $S_{LA}$ across all three foot regions of the lead foot during swing follow through after bat-to-ball contact. These regions of dominant traction and stability will likely differ for other athletes performing different activities within the same sport (e.g., a pitcher throwing a baseball) or differ for athletes performing distinct activities in other sports (e.g., running and kicking in soccer or catching and scrambling in football).

With the foregoing in mind, it may be desirable to provide modifiable cleat arrangements with computationally engineered patterns that concentrate traction and stability at predefined locations of an athlete's feet to optimize power transfer depending on the sport and expected activities of that athlete. FIGS. 5A-5F illustrate six different cleated athletic shoes, respectively designated 310A-310F, with different intermixed cleat designs arranged in distinctive computationally engineered patterns. Footwear 310A of FIG. 5A, for example, includes an intermixed pattern of S-shaped and blade-shaped cleats with a total of eight cleats, composed of two blade-shaped cleats 336 and six S-shaped cleats 338. One blade-shaped cleat 336 is located within the forefoot region at a forward tip of the shoe's sole structure, and the other blade-shaped cleat 336 is located within the hindfoot region at a rearward tip of the shoe's sole structure. Both blade-shaped cleats 336 are transversely oriented at slightly different pitch angles with respect to the longitudinal centerline $CL_L$ of the footwear 310A.

Figures 5A, 5B, 5C, 5D, 5E, 5F:
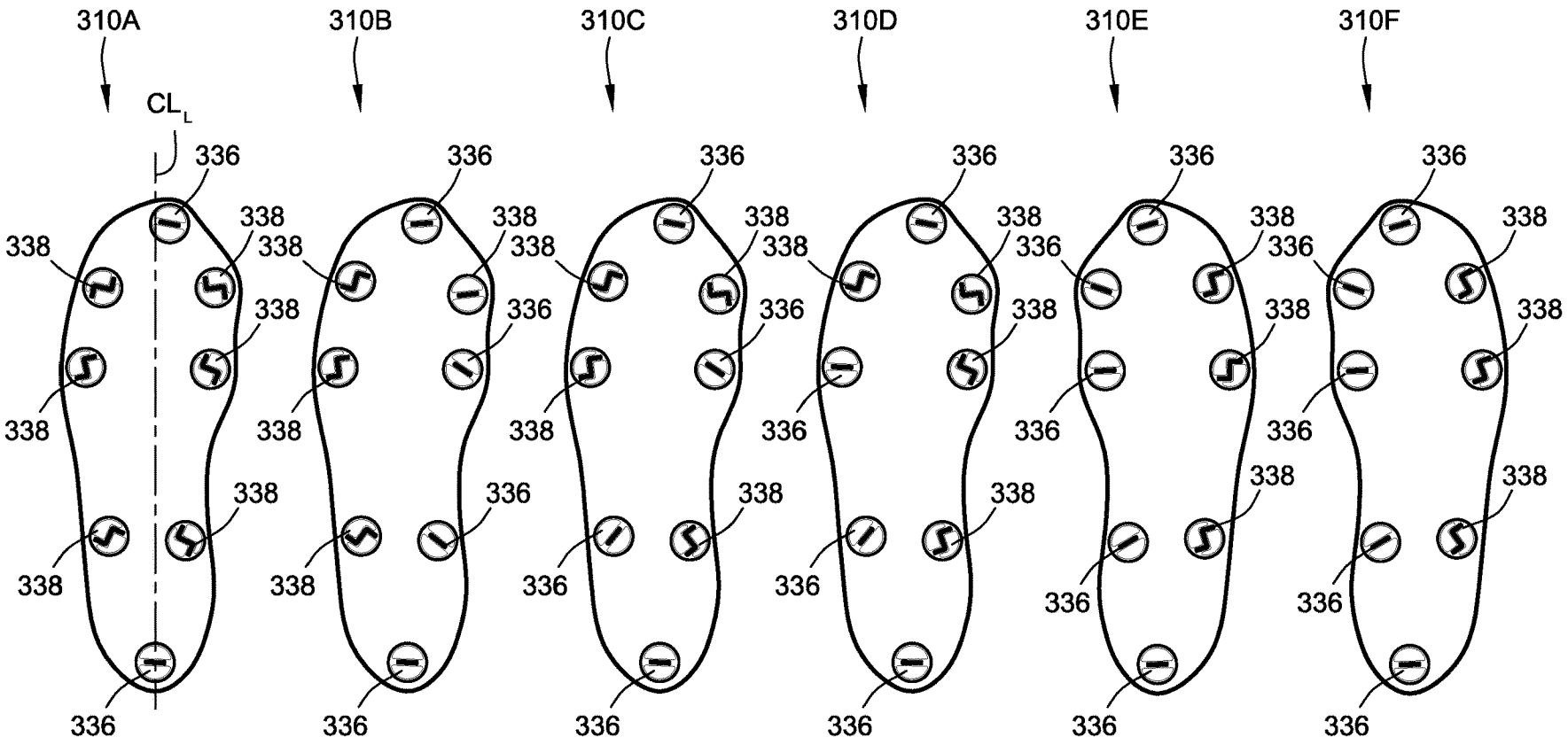
FIGS. 5A-5F are schematic bottom-view illustrations of representative cleated shoes with different intermixed cleat designs arranged in computationally engineered patterns in accord with aspects of the disclosed concepts.

With continuing reference to FIG. 5A, four of the S-shaped cleats 338 are packaged in the forefoot region of footwear 310A, located aft of the forward-most blade-shaped cleat 336 with two at the medial edge and two at the lateral edge of the sole structure. In addition, two of the S-shaped cleats 338 are packaged in the hindfoot region of footwear 310A, both located forward of the rearward-most blade-shaped cleat 336 with one at the medial edge and one at the lateral edge of the sole structure. Each of the S-shaped cleats 338 is rotated by a distinct angular offset with respect to the centerline $CL_L$. It is envisioned that any of the illustrated footwear 310A-310F may include greater or fewer than eight cleats, may include a single type of cleat or more than two cleat types, and the cleats may be arranged in alternative patterns and with alternative orientations.

Footwear 310B of FIG. 5B also includes an intermixed pattern of S-shaped and blade-shaped cleats with a total of eight cleats; in this example, however, the footwear 310B employs five blade-shaped cleats 336 and three S-shaped cleats 338. One blade-shaped cleat 336 is located within the forefoot region at a forward tip of the shoe's sole structure, another blade-shaped cleat 336 is located within the hindfoot region at a rearward tip of the shoe's sole structure, two blade-shaped cleats 336 are located on the medial edge of the forefoot region, and one blade-shaped cleat 336 is located on the medial edge of the hindfoot region. All five blade-shaped cleats 336 of FIG. 3B are oriented at different pitch angles with respect to a longitudinal centerline $CL_L$ (FIG. 5A) of the footwear 310B. Two of the S-shaped cleats 338 are packaged in the forefoot region of footwear 310B, located on the lateral edge of the sole structure aft of the forward-most blade-shaped cleat 336. One S-shaped cleat 338 is packaged in the hindfoot region of footwear 310B, located on the lateral edge of the sole structure forward of the rearward-most blade-shaped cleat 336. Each of the S-shaped cleats 338 of FIG. 3B is rotated by a distinct angular offset with respect to the centerline $CL_L$.

Footwear 310C of FIG. 5C employs four blade-shaped cleats 336 and four S-shaped cleats 338. One blade-shaped cleat 336 is located within the forefoot region at a forward tip of the shoe's sole structure, another blade-shaped cleat 336 is located within the hindfoot region at a rearward tip of the shoe's sole structure, a third blade-shaped cleat 336 is located on the medial edge of the forefoot region, and a fourth blade-shaped cleat 336 is located on the lateral edge of the hindfoot region. All four blade-shaped cleats 336 of FIG. 3C are oriented at different pitch angles with respect to a longitudinal centerline $CL_L$ of the footwear 310C. Three of the S-shaped cleats 338 are packaged in the forefoot region of footwear 310C, located aft of the forward-most blade-shaped cleat 336 with two on the lateral edge of the sole structure and one on the medial edge. One S-shaped cleat 338 is packaged in the hindfoot region of footwear 310C, located on the lateral edge of the sole structure forward of the rearward-most blade-shaped cleat 336. Each of the S-shaped cleats 338 of FIG. 3C is rotated by a distinct angular offset with respect to the centerline $CL_L$.

Turning next to FIG. 5D, footwear 310D employs four blade-shaped cleats 336 and four S-shaped cleats 338. One blade-shaped cleat 336 is located at a forward tip of the shoe's sole structure, another blade-shaped cleat 336 is located at a rearward tip of the shoe's sole structure, a third blade-shaped cleat 336 is located on the lateral edge of the forefoot region, and a fourth blade-shaped cleat 336 is located on the lateral edge of the hindfoot region. All four blade-shaped cleats 336 of FIG. 3D are oriented at different pitch angles with respect to a longitudinal centerline $CL_L$ of the footwear 310C. Three of the S-shaped cleats 338 are packaged in the forefoot region of footwear 310C, located aft of the forward-most blade-shaped cleat 336 with one on the lateral edge of the sole structure and two on the medial edge. One S-shaped cleat 338 is packaged in the hindfoot region of footwear 310D, located on the medial edge of the sole structure forward of the rearward-most blade-shaped cleat 336. Two of the S-shaped cleats 338 of FIG. 3D on the medial edge of the sole structure share a common angular offset with respect to the centerline $CL_L$; the other two S-shaped cleats 338 have distinct angular offsets from each other and from the two that share a common angular offset.

Referring to FIG. 5E, footwear 310E employs five blade-shaped cleats 336 and three S-shaped cleats 338. A first blade-shaped cleat 336 is located at a forward tip of the shoe's sole structure, a second blade-shaped cleat 336 is located at a rearward tip of the shoe's sole structure, two blade-shaped cleats 336 are located on the medial edge of the forefoot region, and a fifth blade-shaped cleat 336 is located on the medial edge of the hindfoot region. Two of the five blade-shaped cleats 336 of FIG. 5E share a common pitch angle with respect to a longitudinal centerline $CL_L$; the remaining three blade-shaped cleats 336 are oriented at different pitch angles with respect to a longitudinal centerline $CL_L$ of the footwear 310E. Two of the S-shaped cleats 338 are packaged in the forefoot region of footwear 310E, both located on the lateral edge of the sole structure. One S-shaped cleat 338 is packaged in the hindfoot region of footwear 310E, located on the lateral edge of the sole structure. All three S-shaped cleats 338 have distinct angular offsets from each other.

Similar to footwear 310E of FIG. 5E, footwear 310F of FIG. 5F employs five blade-shaped cleats 336 and three S-shaped cleats 338. Also similar to the embodiment of FIG. 5E, a first blade-shaped cleat 336 of FIG. 5F is located at a forward tip of the shoe's sole structure, a second blade-shaped cleat 336 is located at a rearward tip of the shoe's sole structure, two blade-shaped cleats 336 are located on the medial edge of the forefoot region, and a fifth blade-shaped cleat 336 is located on the medial edge of the hindfoot region. Also similar to FIG. 5E, two of the five blade-shaped cleats 336 of FIG. 5F share a common pitch angle with respect to a longitudinal centerline $CL_L$; the remaining three blade-shaped cleats 336 are oriented at different pitch angles with respect to a longitudinal centerline $CL_L$ of the footwear 310E. Two of the S-shaped cleats 338 are packaged in the forefoot region of footwear 310E, both located on the lateral edge of the sole structure. One S-shaped cleat 338 is packaged in the hindfoot region of footwear 310E, located on the lateral edge of the sole structure. Unlike FIG. 5E, all three of the S-shaped cleats 338 of FIG. 5F share a common angular offset with respect to the footwear's longitudinal centerline $CL_L$.

Additional features may be reflected in the following clauses:

Clause 1: a cleat structure for an article of footwear, the article of footwear having a sole structure configured to support a foot and contact a ground surface, the cleat structure including: a mounting base configured to attach to the sole structure; a first wall projecting from the mounting base and having opposing first and second lateral sides with a distal end extending between the first and second lateral sides; a first sidewall projecting from the base and adjoining the first lateral side, the first sidewall having a first angled edge projecting at a first oblique angle from the distal end; and a second sidewall projecting from the base, adjoining the second lateral side, and located on a respective side of the first wall opposite that of the first sidewall, the second sidewall having a second angled edge projecting at a second oblique angle from the distal end.

Clause 2: the cleat structure of clause 1, wherein the first sidewall is substantially parallel with the second sidewall.

Clause 3: the cleat structure of clause 1 or clause 2, wherein the first and second sidewalls extend in opposite directions from each other.

Clause 4: the cleat structure of any one of clauses 1 to 3, wherein the first and second sidewalls are substantially orthogonal with the first wall.

Clause 5: the cleat structure of any one of clauses 1 to 4, wherein the first and second oblique angles of the first and second angled edges are between about 35 degrees and about 55 degrees.

Clause 6: the cleat structure of clause 5, wherein the first and second oblique angles are both about 45 degrees.

Clause 7: the cleat structure of any one of clauses 1 to 6, wherein the first wall, the first sidewall, and the second sidewall are each substantially flat panels with multiple polygonal faces.

Clause 8: the cleat structure of any one of clauses 1 to 6, wherein the first and second lateral sides of the first wall are arcuate, and wherein respective sidewall sides of the first and second sidewalls adjoining the first and second lateral sides of the first wall are arcuate.

Clause 9: the cleat structure of any one of clauses 1 to 7, wherein the first and second sidewalls each have polyhedral geometries with opposing major faces having right trapezium shapes.

Clause 10: the cleat structure of any one of clauses 1 to 9, wherein the mounting base, the first wall, and the first and second sidewalls are integrally formed as a single-piece structure.

Clause 11: the cleat structure of any one of clauses 1 to 10, wherein the mounting base includes a first mounting plate projecting from a first proximal end of the first sidewall and a second mounting plate projecting from a second proximal end of the second sidewall.

Clause 12: the cleat structure of clause 11, wherein the first mounting plate projects orthogonally from the first sidewall and the second mounting plate projects orthogonally from the second sidewall.

Clause 13: the cleat structure of clause 11 or clause 12, wherein the first mounting plate projects in a first direction from the first sidewall and the second mounting plate projects in a second direction, opposite the first direction, from the second sidewall.

Clause 14: an article of footwear comprising: an upper configured to receive a foot of a user; a sole structure attached to the upper and including a ground-facing outsole, the sole structure configured to support thereon the foot of the user and contact a ground surface; and a cleat structure projecting downwardly from the ground-facing outsole, the cleat structure including: a mounting base attached to the sole structure; a center wall attached at a proximal end thereof to and projecting downwardly from the mounting base, the center wall having opposing first and second lateral sides and a distal end, opposite the proximal end, extending between the first and second lateral sides; a first sidewall projecting downwardly from the base and adjoining the first lateral side of the center wall, the first sidewall having a first angled edge projecting at a first oblique angle from a first edge of the distal end of the center wall; and a second sidewall projecting downwardly from the base, adjoining the second lateral side of the center wall, and located on a respective side of the center wall opposite that of the first sidewall, the second sidewall having a second angled edge projecting at a second oblique angle from a second edge of the distal end of the center wall, the second edge opposite the first edge.

Clause 15: a method of manufacturing a cleat structure for an article of footwear, the article of footwear having a sole structure configured to support a foot, the method comprising: forming a mounting base configured to attach to the sole structure; forming a first wall projecting from the mounting base and having opposing first and second lateral sides with a distal end extending between the first and second lateral sides; forming a first sidewall projecting from the base and adjoining the first lateral side of the first wall, the first sidewall having a first angled edge projecting at a first oblique angle from the distal end of the first wall; and forming a second sidewall projecting from the base, adjoining the second lateral side, and located on a respective side of the first wall opposite that of the first sidewall, the second sidewall having a second angled edge projecting at a second oblique angle from the distal end of the first wall.

Clause 16: the method of clause 15, wherein the first sidewall is substantially parallel with the second sidewall.

Clause 17: the method of clause 15 or clause 16, wherein the first and second sidewalls extend in opposite directions from each other.

Clause 18: the method of any one of clauses 15 to 17, wherein the first and second sidewalls are substantially orthogonal with the first wall.

Clause 19: the method of any one of clauses 15 to 18, wherein forming the mounting base, forming the first wall, forming the first sidewall, and forming the second sidewall include casting, stamping, or machining the cleat structure from a metallic material.

Clause 20: the method of any one of clauses 15 to 19, wherein the first and second oblique angles of the first and second angled edges are between about 35 degrees and about 55 degrees.

Clause 21: the method of any one of clauses 15 to 20, wherein the first wall, the first sidewall, and the second sidewall are each substantially flat panels with multiple polygonal faces.

Clause 22: the method of any one of clauses 15 to 21, wherein the first and second lateral sides of the first wall are arcuate, and wherein respective sidewall sides of the first and second sidewalls adjoining the first and second lateral sides of the first wall are arcuate.

Clause 23: the method of any one of clauses 15 to 18, 20 and 21, wherein forming the mounting base, forming the first wall, forming the first sidewall, and forming the second sidewall include integrally forming the cleat structure as a single-piece structure from a polymeric material or a metallic material.

Clause 24: the method of any one of clauses 15 to 23, wherein the mounting base includes a first mounting plate projecting from a first proximal end of the first sidewall and a second mounting plate projecting from a second proximal end of the second sidewall.

Clause 25: the method of any one of clauses 15 to 24, wherein the first mounting plate projects orthogonally in a first direction from the first sidewall, and wherein the second mounting plate projects orthogonally in a second direction, opposite the first direction, from the second sidewall.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. A cleat structure for an article of footwear, the article of footwear having a sole structure configured to support a foot and contact a ground surface, the cleat structure including:

a mounting base configured to attach to the sole structure;

a first wall projecting from the mounting base and having a substantially flat polyhedral body with opposing first and second lateral ends and a distal longitudinal end extending between the first and second lateral ends;

a first sidewall projecting from the base and adjoining the first lateral end of the polyhedral body of the first wall, the first sidewall having a first angled edge projecting at a first oblique angle from the distal longitudinal end, the first sidewall having first opposing major faces each with a first right trapezium shape having a first obliquely angled edge; and a second sidewall projecting from the base, adjoining the second lateral end of the polyhedral body of the first wall, and located on a respective side of the first wall opposite that of the first sidewall, the second sidewall having a second angled edge projecting at a second oblique angle from the distal longitudinal end, the second sidewall having second opposing major faces each with a second right trapezium shape having a second obliquely angled edge.

2. The cleat structure of claim 1, wherein the first sidewall is substantially parallel with the second sidewall.

3. The cleat structure of claim 1, wherein the first and second sidewalls extend in opposite directions from each other.

4. The cleat structure of claim 1, wherein the first and second sidewalls are substantially orthogonal with the first wall.

5. The cleat structure of claim 1, wherein the first and second oblique angles of the first and second angled edges are between about 35 degrees and about 55 degrees.

6. The cleat structure of claim 5, wherein the first and second oblique angles are both about 43 degrees.

7. The cleat structure of claim 1, wherein the first sidewall and the second sidewall are each substantially flat panels with multiple polygonal faces.

8. The cleat structure of claim 1, wherein respective sidewall edges of the first and second sidewalls adjoining the first and second lateral ends of the first wall are arcuate.

9. The cleat structure of claim 1, wherein the mounting base, the first wall, and the first and second sidewalls are integrally formed as a single-piece structure.

10. The cleat structure of claim 1, herein the mounting base includes a first mounting plate projecting from a first proximal end of the first sidewall and a second mounting plate, distinct and spaced from the first mounting plate, projecting from a second proximal end of the second sidewall.

11. The cleat structure of claim 10, wherein the first mounting plate projects substantially orthogonally from the first sidewall and the second mounting plate projects substantially orthogonally from the second sidewall.

12. The cleat structure of claim 11, wherein the first mounting plate projects in a first direction from the first sidewall and the second mounting plate projects in a second direction, opposite the first direction, from the second sidewall.

13. An article of footwear comprising:

an upper configured to receive a foot of a user;

a sole structure attached to the upper and including a ground-facing outsole, the sole structure configured to support thereon the foot of the user and contact a ground surface; and a cleat structure projecting downwardly from the ground-facing outsole, the cleat structure including:

a mounting base attached to the sole structure;

a center wall attached at a proximal end thereof to and projecting downwardly from the mounting base, the center wall having a substantially flat polyhedral body with opposing first and second lateral ends and a distal longitudinal end, opposite the proximal end, extending between the first and second lateral ends;

a first sidewall projecting downwardly from the base and adjoining the first lateral end of the center wall, the first sidewall having a first angled edge projecting at a first oblique angle from a first edge of the distal longitudinal end, the first sidewall having a first pair of opposing major faces each with a first right trapezium shape having a first obliquely angled edge; and a second sidewall projecting downwardly from the base, adjoining the second lateral end of the center wall, and located on a respective side of the center wall opposite that of the first sidewall, the second sidewall having a second angled edge projecting at a second oblique angle from a second edge of the distal longitudinal end of the center wall, the second edge opposite the first edge, the second sidewall having a second pair of opposing major faces each with a second right trapezium shape having a second obliquely angled edge.

14. The article of footwear of claim 13, wherein the first sidewall is substantially parallel with the second sidewall.

15. The article of footwear of claim 13, wherein the first and second sidewalls extend in opposite directions from each other.

16. The article of footwear of claim 13, wherein the first and second sidewalls are substantially orthogonal with the center wall.

17. The article of footwear of claim 13, wherein the first and second oblique angles of the first and second angled edges are between about 35 degrees and about 55 degrees.

18. The article of footwear of claim 17, wherein the first and second oblique angles are both about 43 degrees.

19. The article of footwear of claim 13, wherein the first sidewall and the second sidewall are each substantially flat panels with multiple polygonal faces.

20. The article of footwear of claim 13, wherein the first sidewall has a first arcuate sidewall edge adjoining the first lateral end of the center wall, and the second sidewall has a second arcuate sidewall edge adjoining the second lateral end of the center wall.

21. The article of footwear of claim 13, wherein the cleat structure, including the mounting base, the center wall, and the first and second sidewalls, is integrally formed as a single-piece structure.

22. The article of footwear of claim 13, wherein the mounting base includes a first mounting plate projecting from a first proximal end of the first sidewall and a second mounting plate, distinct and spaced from the first mounting plate, projecting from a second proximal end of the second sidewall.

23. The article of footwear of claim 22, wherein the first mounting plate projects substantially orthogonally from the first sidewall and the second mounting plate projects substantially orthogonally from the second sidewall.

24. The article of footwear of claim 22, wherein the first mounting plate projects in a first direction from the first sidewall and the second mounting plate projects in a second direction, opposite the first direction, from the second sidewall.

25. A cleat structure for an article of footwear, the article of footwear having a sole structure configured to support a foot and contact a ground surface, the cleat structure including:

a mounting base configured to attach to the sole structure;

a first wall projecting from the mounting base and having a substantially flat polyhedral body with opposing first and second lateral ends and a distal longitudinal end extending between the first and second lateral ends;

a first sidewall projecting from the base and adjoining the first lateral end of the polyhedral body of the first wall, the first sidewall having a first angled edge projecting at a first oblique angle from the distal longitudinal end; and a second sidewall projecting from the base, adjoining the second lateral end of the polyhedral body of the first wall, and located on a respective side of the first wall opposite that of the first sidewall, the second sidewall having a second angled edge projecting at a second oblique angle from the distal longitudinal end, wherein the mounting base includes a first mounting plate projecting from a first proximal end of the first sidewall and a second mounting plate, distinct and spaced from the first mounting plate, projecting from a second proximal end of the second sidewall.

* * * * *